US009084941B1

(12) United States Patent
Fram

(10) Patent No.: US 9,084,941 B1
(45) Date of Patent: Jul. 21, 2015

(54) COMBINATION RIDE FOR AMUSEMENT PARK

(71) Applicant: Eric Fram, Beverly Hills, CA (US)

(72) Inventor: Eric Fram, Beverly Hills, CA (US)

( * ) Notice: Subject to any disclaimer, the term of this patent is extended or adjusted under 35 U.S.C. 154(b) by 0 days.

(21) Appl. No.: 14/492,496

(22) Filed: Sep. 22, 2014

(51) Int. Cl.
*A63G 31/00* (2006.01)

(52) U.S. Cl.
CPC ..... *A63G 31/00* (2013.01)

(58) Field of Classification Search
CPC ..... A63G 7/00; A63G 21/00; A63G 31/00; B60S 13/02; B61J 1/10; B65G 1/0428
USPC ..... 104/53, 54, 55, 56, 58, 59, 63, 64, 65, 104/67, 69, 71, 74, 75, 76, 78, 79, 50; 472/59
See application file for complete search history.

(56) References Cited

U.S. PATENT DOCUMENTS 4,357,875 A * 11/1982 Scheel ..... 104/50
5,623,878 A 4/1997 Baxter et al.
6,095,926 A 8/2000 Hettema et al.
6,098,549 A 8/2000 Mares
6,220,171 B1 4/2001 Hettema et al.
6,227,121 B1 5/2001 Mares
6,341,564 B1 1/2002 Ochi
6,386,115 B2 5/2002 Mares
7,484,460 B2 2/2009 Blum et al.
7,987,793 B2 8/2011 Blonk et al.
2002/0183123 A1 * 12/2002 De-Gol ..... 472/59
2005/0098056 A1 * 5/2005 Roodenburg et al. ..... 104/53

* cited by examiner

*Primary Examiner* — Mark Le
(74) *Attorney, Agent, or Firm* — Cislo & Thomas, LLP

(57) ABSTRACT

An amusement park ride that combines the features of multiple park rides into one. The amusement park ride has a car, a base, and a platform. The car is configured to ride on the rails of a standard roller coaster track. The base has a track segment to receive the car from a roller coaster track and braking system to secure the car on the base. The platform has multiple hydraulic lifts that allows the car to have six degrees of freedom so as to function as a motion simulator. The platform can also move along a track or the ground to function as a dark ride. The locking magnetic brake can release the car either forwards or backwards, or dispatch the car onto one of multiple segments of track to offer a variety of combinations of alternating roller coaster, motion simulator, and dark rides.

8 Claims, 4 Drawing Sheets

COMBINATION RIDE FOR AMUSEMENT PARK

TECHNICAL FIELD

This invention relates to a vehicle for an amusement park ride that combines the technologies and experiences of a roller coaster, motion simulator, and dark ride in a novel, fluid, and versatile fashion.

BACKGROUND

Theme parks and amusement parks over the years have strived to create immersive, fluid themed attractions such as dark rides, roller coasters, and simulators. Particularly in recent years, these theme parks have introduced attractions which combine these different types of ride experiences. Unfortunately, these ambitious amalgamations can lack realism or variability due to the limits of their technological systems, including their ride vehicles. For example, to combine the sensations of a roller coaster and a motion simulator, some rides use shaker tables under roller coaster track segments, which provide a less realistic experience than the standard motion simulator vehicle.

For the foregoing reasons there is a need for a vehicle that more effectively, seamlessly, and realistically combines a roller coaster, motion simulator, and dark ride.

SUMMARY

The present invention is directed to an amusement park ride vehicle that allows a patron to ride multiple rides at an amusement park while sitting in a single vehicle. The ride vehicle comprises a car configured to seat one or more riders, a pod to receive the car, and a base upon which the pod is mounted, the base configured to move along a surface. The base comprises a lift mechanism to create rolling, pivoting, and rotating motion for the pod and car. The base also comprises wheels to allow for translational movement. Therefore, with the base, the ride vehicle can experience six degrees of freedom.

The pod has a track segment extending forwardly and rearwardly past the outer perimeter of the pod that allows a ride vehicle to ride capable of riding on a roller coaster ride to ride onto the pod. The pod also has a braking system to stop the car once properly positioned on the pod.

To enhance the ride experience, the ride vehicle can have numerous options, such as surround-sound speakers, stadium-seat-style seating, a steering mechanism, and screens to play an audiovisual work related to the ride at hand.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The invention of the present application is directed towards an amusement park ride vehicle 100 for a versatile amusement park ride that allows a patron to experience a variety of amusement park ride types in a single vehicle. With reference to the Figures, the ride vehicle 100 comprises a car 102 configured to seat one or more riders and a transition vehicle 200 that allows the car 102 to experience six degrees of freedom. The transition vehicle 200 is configured to secure the car 102 and send the car 102 from one ride to another. By way of example only, a rider may get into the car 102 and be taken through a roller coaster ride. Upon completion of the roller coaster ride, the car 102 rolls onto the transition vehicle 200. The transition vehicle 200 can then take the rider through a dark ride. Upon completion of the dark ride, the transition vehicle 200 may stop in a simulator room having a projection screen. An audiovisual recording can be played showing an action scene from a first person's viewpoint. The transition vehicle 200, equipped with a lift mechanism 254 can mimic the motion seen by the rider to feel as if the rider is actually in the action scene.

Figure 1:
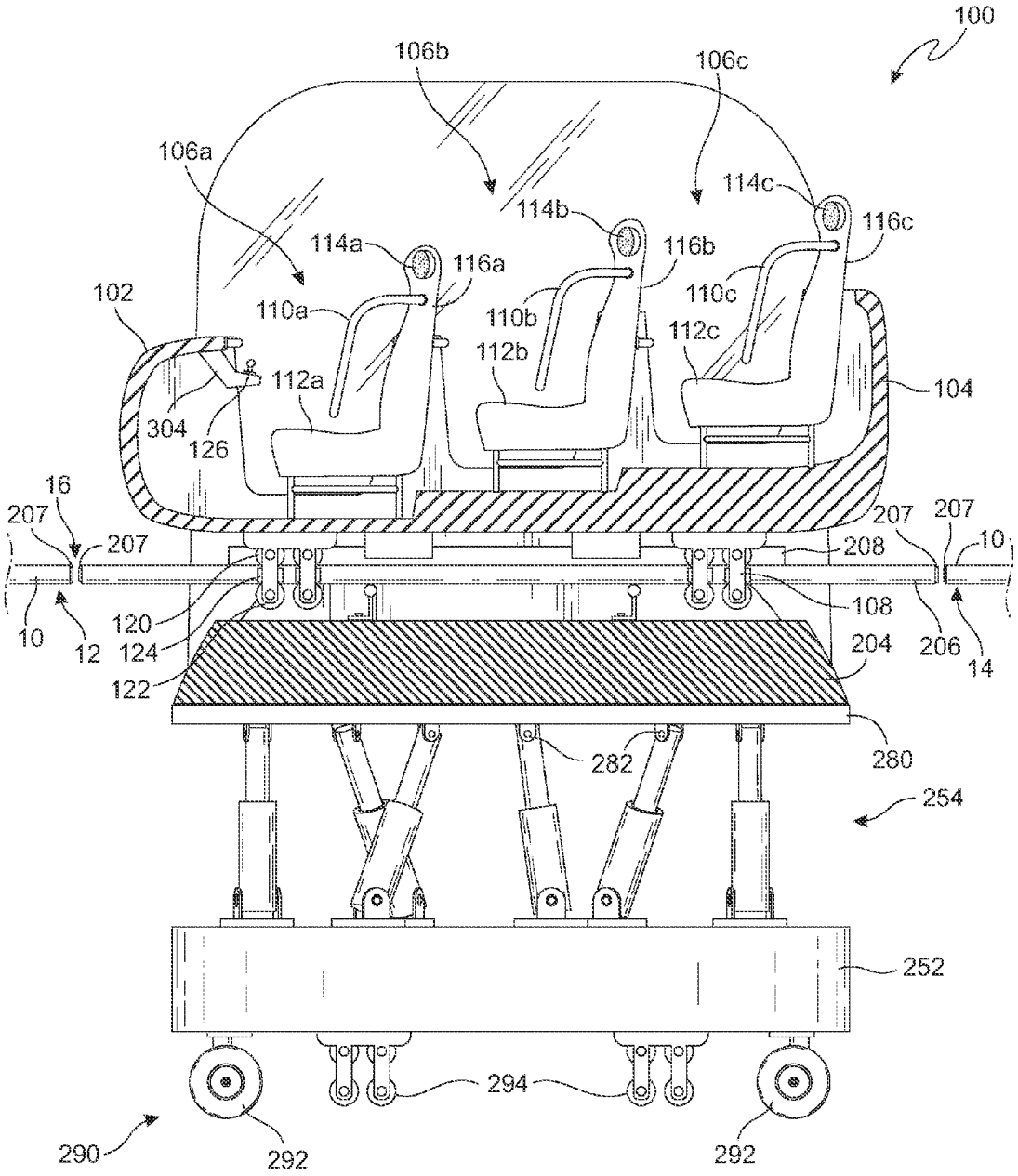
FIG. 1 shows a side view of an embodiment of the present invention with the car and the pod shown in cross section down the longitudinal axis

With reference to FIG. 1, the car 102 may be any general amusement park car capable of holding one or more riders. By way of example only, the car 102 may be a general roller coaster car. Preferably, the car 102 comprises a body 104 having one or more compartments 106*a-c* to hold one or more riders, and a plurality of track wheels 108 configured to ride on a track 10. The body 104 may further have a restraint system 110*a-c* to keep the riders in their respective compartments, such as a seatbelt, shoulder harness, lap bar, an over-the-shoulder restraint, and the like, or any combination thereof.

In the preferred embodiment, there may be three rows of compartments 106*a*, 106*b*, 106*c*. Each compartment may have a seat 112*a-c* for the riders to sit and enjoy the ride. In some embodiments, seats 112*a-c* may not be necessary and the riders can stand and enjoy the ride. In embodiments with seats 112*a-c*, the seats 112*a-c* may be arranged as stadium-style seating with a second row seat 112*b* elevated higher than a first row seat 112*a*, and a third row seat 112*c* higher than the second row seat 112*b* so that riders in the second and third row seats 112*b*, 112*c* can see over riders in front of them.

Preferably, each compartment 106*a-c* is equipped with speakers 114*a-c*, such as surround sound speakers. The speakers 114*a-c* are positioned somewhere near the rider's head. For example, the speakers 114*a-c* may be on a dividing wall between compartments, on the back rest 116*a-c* of the seats 112*a-c*, or on the headrests. The speakers 114*a-c* can be used for a variety of purposes, including, but not limited to, providing the audio component of a dark ride or a simulation ride, announcements, instructions, other forms of entertainment, and the like.

The track wheels 108 on the car 102 are configured to allow the car 102 to ride along tracks 10 of a ride (referred to as ride tracks). Typically the track wheels 108 are attached to the car 102 on its bottom side. This allows the car 102 to ride on top of the ride tracks 10. However, some cars 102 may have the track wheels 108 attached to the top side of the car 102 to allow the car 102 to ride below the tracks 10. The car 102 may be equipped with multiple sets of track wheels strategically placed to enhance performance and safety of the ride. Each set of track wheels 108 may comprise any one or more of a road wheel 120 positioned on top of the track 10, an upstop wheel 122 positioned below the track 10, a guide wheel 124 position on the inside or outside of the track 10, and any combination thereof. Preferably, each set of track wheels 108 comprises one of each type of wheel. Preferably, the car 102 has at least two sets of wheels 108, one on each side (left and right) of the car. More preferably, the car 102 has one or more sets of wheels 108 at each of the corners of the car. Therefore, in the preferred embodiment, the car 102 should have at least four sets of wheels 108, but can have more sets, for example, in the middle on the left and right sides.

In order for the rider to experience a different ride while remaining in the same car 102, the car 102 is mountable on a transition vehicle 200. The transition vehicle 200 is capable of moving from one ride station to another as well as providing motion for the car 102 with at least six degrees of freedom to allow the rider to experience rolling (or pivoting) from side to side, swiveling (or yawing) left and right, tilting (or pitching) forward and backward, elevating and descending up and down, moving forward and backward, moving left and right, and any combination thereof while on the transition vehicle 200.

Figure 2:
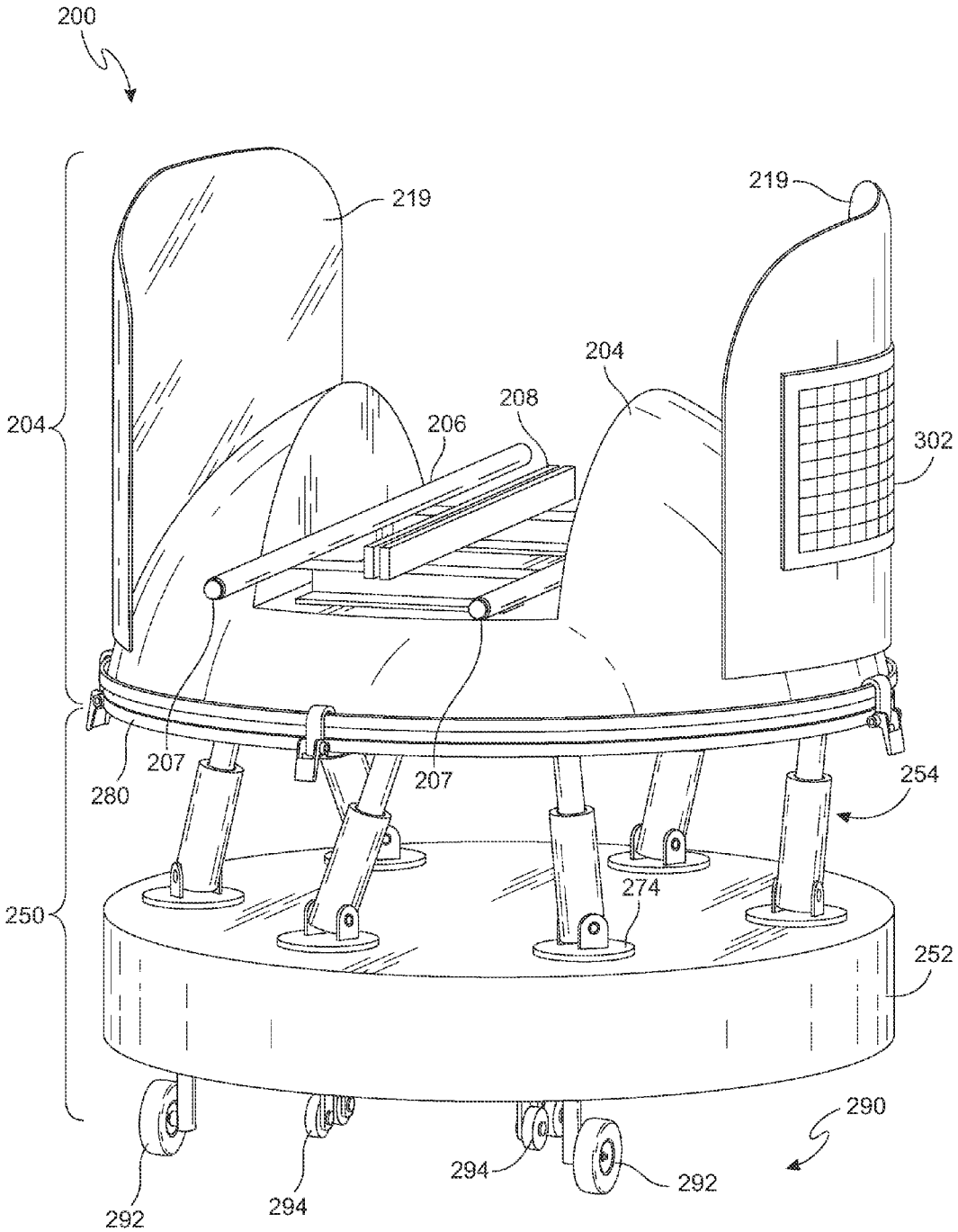
FIG. 2 shows a perspective view of an embodiment of the transition vehicle.
Figure 3:
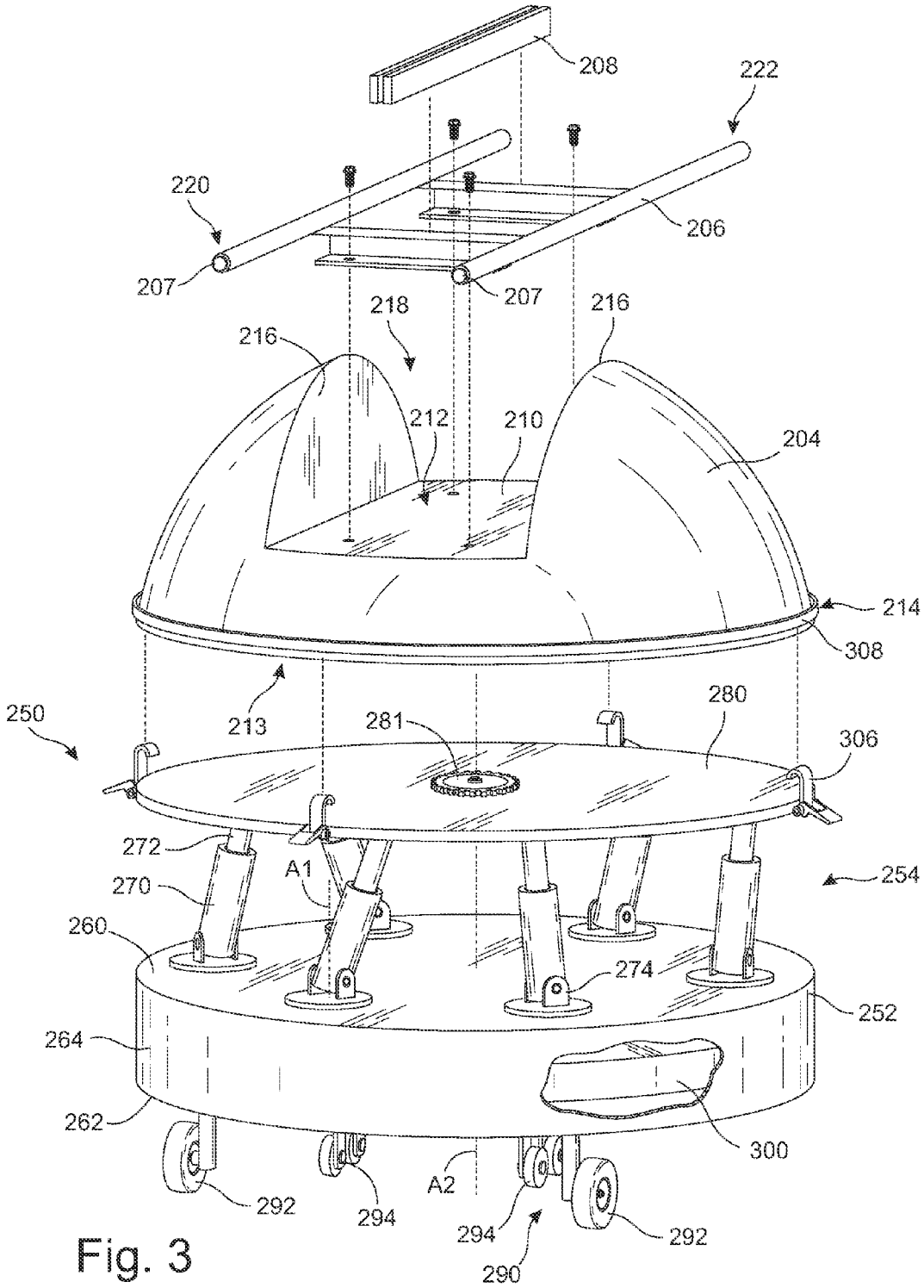
FIG. 3 shows an exploded view of an embodiment of the transition vehicle with a portion of the base removed to reveal the motor.

With reference to FIGS. 2 and 3, the transition vehicle 200 comprises a pod 204 to receive the car 102, and a base 250 to provide motion for the car 102. The pod 204 has a track segment 206 mounted on the pod 204, and a braking system 208 associated with the track segment 206. The pod 204 can be any foundational structure sufficient to hold a car 102. The pod 204 has a floor 210 having a top side 212 and a bottom side 213 opposite the top side 212, the top and bottom sides 212, 213 are bound by an outer perimeter 214. The track segment 206 and braking system 208 are securely mounted on the top side 212 of the floor 210. In some embodiments, extending upwardly from opposing sides of the outer perimeter 214 is a pair of walls 216. Thus, the walls 216 and the floor 210 define a channel 218 into which the car 102 can enter and exit. In the preferred embodiment, the pod 204 may be dome-shaped with the channel 218 cut out in the middle so as to define the two opposing walls 216.

In some embodiments, the wall 216 or portions of the wall 216 on the inside may comprise a screen 219 capable of displaying an audiovisual work. The audiovisual work may correspond with the current ride in progress, thereby providing additional environmental scenery to enhance the ride experience. In some embodiments, the screen 219 may extend up from the outer perimeter 214 of the pod 204 rather than being on the walls 216 of the pod 204. The objective is to prevent the riders from seeing past the screen 219 so that they are forced to see the screen 219 during one of the rides in which the car 102 is still in the pod 204. However, when the riders move to a ride that does not require the transition vehicle 200, then the riders' views are no longer obstructed to the side. Therefore, a pair of screens 219 is attached on opposite sides of the transition vehicle 200 adjacent to the sides of the pod 204 so as not to obstruct the car's ability to move in and out of the pod 204.

The track segment 206 is essentially a segment of a ride track 10, such as a roller coaster track. The ride track 10 may have to be modified so as to have a free start end 12 and a free finish end 14, rather than being one continuous loop. The free start end 12 and the free finish end 14 defining a gap 16 therebetween. The track segment 206 has a front end 220 and a back end 222. The distance from the front end 220 to the back end 222 defines the length of the track segment 206. The dimensions of the gap 16 is substantially similar to the dimensions of the track segment 206. Therefore, when the track segment 206 is inserted into the gap 16, the ride track 10 essentially becomes one continuous loop. The track segment 206 may also be attached to the pod 204 in a manner that provides spacing above, below, and to the sides of the track segment 206. This allows the track wheels 108 of the car 102 to roll onto the track segment 206 without interference from the pod 204.

Figure 4:
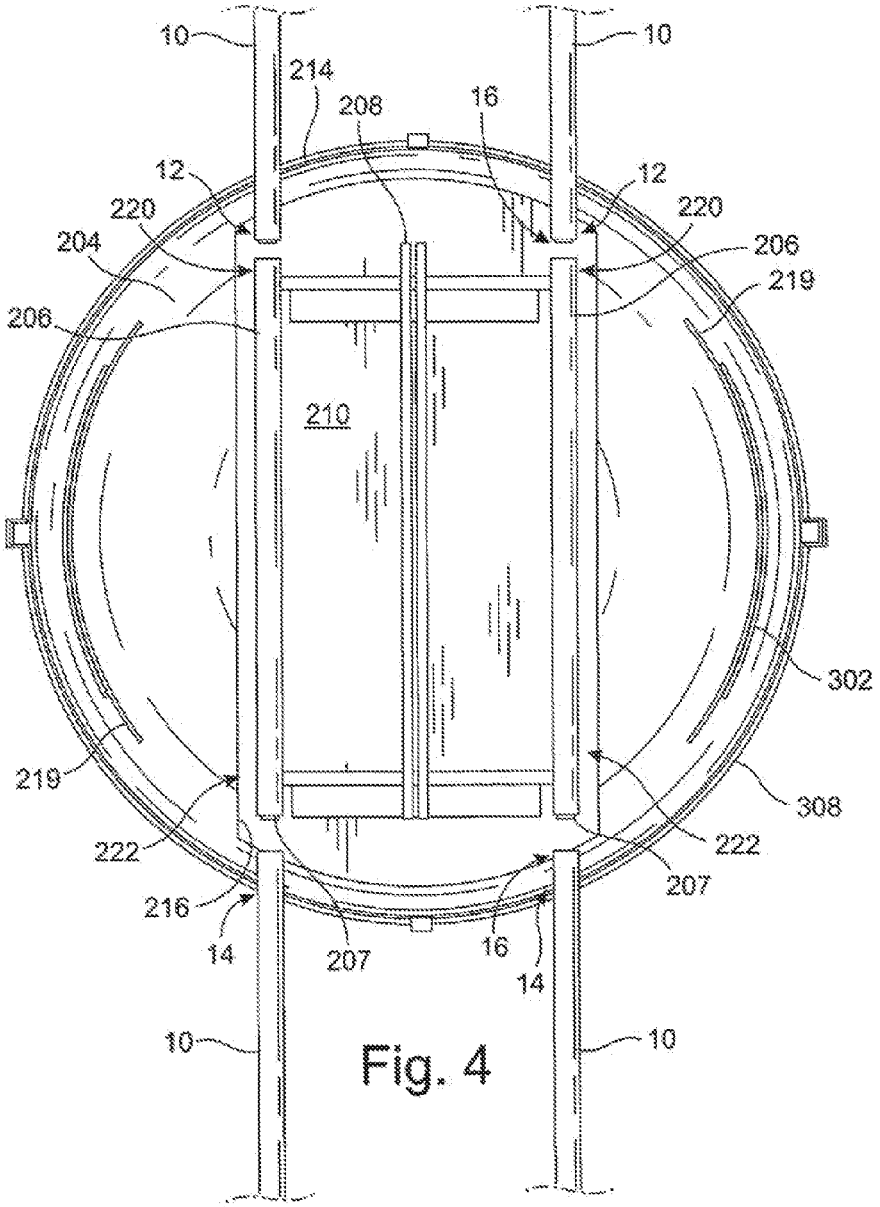
FIG. 4 shows a diagrammatic representation of another embodiment.

In order for the track segment 206 to be inserted into the gap 16, the track segment 206 is secured to the floor 210 inside the channel 218. Preferably, the front and back ends 220, 222 of the track segment 206 project out past the outer perimeter 214 of the pod 204 at the front and the back ends of the pod 204. This allows the track segment 206 to align with and connect to the ride track 10 without interference from the pod 204. In some embodiments, the track segment 206 may extend out to the outer perimeter of the pod on opposite sides. The dimensions of the pod 204 may be such that the pod 204 fits inside the gap 16 of the ride track 10. Thus, when the pod 204 is inserted inside the gap 16 of the ride track 10, the track segment 206 is aligned with and forms a continuous relationship with the ride track 10. In some embodiments, the track segment 206 may be shorter than the dimensions of the pod 204 so as to leave a space in between the front and back ends 220, 222 and the perimeter edge 214 of the pod 204. The space accommodates the terminal ends 12, 14 of the ride track 10. Thus, when the track segment 206 is inserted inside the gap 16, the terminal ends 12, 14 of the ride track 10 may lie on to of the floor 210 (FIG. 4) in the space so as to connect with the track segment 206. Since the terminal ends 12, 14 of the ride track 10 are housed inside the pod 204, this prevents unnecessary rotational movement of the pod 204 since the terminal ends 12, 14 of the roller coaster track 10 would abut against the walls 216 of the pod 206.

To facilitate the alignment of the track segment 206 to the ride track 10, sensors 207 may be attached to the track segment 206 and at the ends 12, 14 of the ride track 10. The sensors 207 communicate or detect each other to determine a proper connection. For example, the sensors may attract one another or detect their proximity to facilitate the alignment.

As shown in FIG. 2, the braking system 208 is operatively connected to the pod 204, either through direct attachment to the pod 204, or through the track segment 206. The braking system 208 can be any system that can halt the movement of the car 102 while the car 102 is inside the pod 204. For example, the braking system 208 may be in the form of a retractable projection into the channel 218 at the front end, the back end, both ends of the channel 218, or anywhere therebetween. For example, the retractable projection may be gates, bars, straps, chains, fences, locks and the like that can obstruct the movement of the car 102 or the track wheels 108 of the car 102. The braking system 208 may also be in the form of a magnetic braking system. For example, an electromagnet located in between the track segment 206 along the longitudinal axis may be used stop the movement of the car 102 and secure the car 102 in position in the pod 204. Preferably, the braking system 208 is equipped with a fail-secure mechanism that keeps the brakes on or locked in the event of a power failure.

To provide movement for the pod 204, the pod 204 is placed on top of a base 250. The base 250 is configured to move along a surface for translational movement (i.e. movement along the three coordinate axes) as well as rotational movement (i.e. rotation about the three coordinate axes). In general, the base 250 is configured to provide at least 6 degrees of freedom with regards to the types of movements it can perform.

The base 250 comprises a foundation 252, a lift mechanism 254 mounted on the foundation 252 and connected to the pod 204, and a plurality of wheels 290 attached to the bottom side of the foundation 252. The foundation 252 provides the structural support for the lift mechanism 254 as well as providing the mechanism for transporting the pod 204 from one location to another location. The foundation 252 may be any flat, rigid structure to support the pod 204 and the car 102. For example, the foundation 252 may be a sturdy plate made of metal, wood, plastic, and the like. In the preferred embodiment, the foundation 252 may be circular in shape; however, any shape can be used, such as square, rectangular, triangular, and the like.

The foundation 252 has a top side 260 and a bottom side 262. The lift mechanism 254 is mounted on the top side 260. Preferably, the lift mechanism 254 is a plurality of hydraulic jacks. The hydraulic jacks are strategically located on the top side 260 of the foundation 252 to provide three degrees of freedom to create, for example, rolling, swiveling, and tilting motion for the pod 204 and car 102. By way of example only, a plurality of hydraulic jacks may be positioned along the periphery 264 of the foundation 252 in an evenly spaced apart manner. Each hydraulic jack may comprise a set of telescoping arms 270, 272 that allows the hydraulic jacks to lengthen and shorten. Each hydraulic jack may also have articulating arms.

For example, the hydraulic jacks may be attached to the foundation 252 with a coupling 274 that allows the hydraulic jack to move in a swiveling, rotating, toggling, or like manner. For example, the coupling 274 may be a universal joint, hinge, and the like. Each coupling 274 may define a vertical axis A1 extending perpendicularly up from the foundation 252. The hydraulic jack may toggle back and forth from one side of the vertical axis A1 to another, rotate about the vertical axis A1, swivel around the vertical axis A1 or any combination thereof.

In some embodiments, the hydraulic jacks may be directly connected to the pod 204. In other embodiments, the hydraulic jacks may be connected to a plate 280 upon which the pod 204 may be secured. In either case, the connection of the hydraulic jacks to the pod 204 or the plate 280 may be via a movable coupling 282, such as a universal joint, hinge, and the like. This will allow the hydraulic jacks to swivel, rotate, toggle, and otherwise move relative to the foundation 252.

In embodiments in which the base 250 is attached to the pod 204 by a plate 280, the attachment between the pod 204 and the plate 280 may be configured to allow for rotation of the pod 204 relative to the base 250. For example, the plate 280 may comprise gears 281, pulleys, and the like to control the rotation of the pod 204 about the base 250. This will allow the car 102 to experience a spinning action relative to a vertical axis A2 perpendicular to the base 250. This will allow the rider to experience a 360 degree panoramic view. A latch system may be used to connect the plate to the pod 204 while still permitting rotation of the pod relative to the plate 280. The latch system may have a plurality of latches 306 attached to the plate 280 and a groove 308 attached to the pod 204. The groove 308 may be circular such that when the latch 306 attaches to the groove 308, the pod 204 and the plate 280 cannot be separated but rotational movement relative to each other is permitted.

In some embodiments, any translational or rotational movement may be controlled by the ride. In some embodiments, any translational or rotational movement may be controlled by the rider. In some embodiments, any translational or rotational movement may be controllable by either the ride or the rider, or both. This way, in some rides the spinning or rotating action may be controlled by the ride, such as in a simulator ride, and in another ride, the spinning or rotating action may be controlled by the rider, such as in a dark ride. In embodiments in which the rider has control over any movement, an override feature may be provided to take control away from the rider. In order to accommodate the rider's ability to rotate or spin the car 102, the car 102 may further comprise a steering mechanism 126 in the form of a wheel, joystick, buttons, and the like.

On the bottom side 262 of the foundation 252 are a plurality of base wheels 290. The base wheels 290 allow the base 250 to move from location to location, thereby, allowing the car 102 to move from one place to another. For example, the car 102 can move from a roller coaster ride to a motion simulator station. In addition, the base wheels 290 could take the rider through a dark ride. Therefore, the base wheels 290 may comprise multiple sets of different types of wheels. For example, a set of ground wheels 292 may be designed to roll along a typical flat surface, such as the ground or the floor. These ground wheels 292 may comprise rubber treads to roll along a variety of different types of surfaces. A second set of wheels, referred to as track wheels 294, may be configured to roll along a track, for example, in a dark ride. This set of track wheels 294 may be similar to the set of track wheels 108 attached to the car 102. This improves the versatility of the ride vehicle 100 by allowing the ride vehicle 100 to move from ride to ride regardless of whether or not there is a track system in between the rides.

In use, one or more riders will secure themselves with the restraint system 110 inside a car 102 mounted on a transition vehicle 200. The first ride may be a roller coaster ride. The ride track 10 may be predominately continuous except at the beginning 12 and the end 14 where a gap 16 exists. The transition vehicle 200 will be inserted into the gap 16 so that the track segment 206 of the transition vehicle 200 aligns with the tracks 10 of the roller coaster ride. Sensors 207 may facilitate this alignment. This allows the car 102 to move on to the ride track 10 and be taken through the roller coaster ride. At the termination of the roller coaster ride, the car 102 stops on the transition vehicle 200 due to the braking system 208 in the transition vehicle 200. The transition vehicle 200 then moves out of the gap 16 of the ride track 10 and moves to the next ride which may be a simulator ride.

The transition vehicle 200 may move along a set of tracks headed towards the simulator ride. Alternatively, the transition vehicle 200 may be able to roll on a set of ground wheels 292 that allow transition vehicle 200 to move along any terrain without a track. The ground wheels 292 may be automatically controlled by a central control unit. In some embodiments, the riders may have a steering mechanism 126 that can be used to maneuver the transition vehicle 200 to the next ride.

The transition vehicle 200 may comprise a motor 300 to create motion in the car (translational or rotational). The motor 300 may be an electric motor, a combustion engine, and the like, or any combination thereof. Preferably, the motor 300 is hidden within the base 250. The motor 300 may be powered by typical energy sources, such as battery, gas, and fuels, or alternative energy sources, such as solar power, or any combination thereof. By way of example only, the pod 204 and/or the base 250 may comprise solar panels 302 to power the motor 300 and any other electronic device on the vehicle 100.

The vehicle 100 may further comprising a navigation system 304 to allow the central control unit to determine the location of the vehicle 100 and guide the vehicle 100 to the next ride, if necessary.

The simulator ride is typically a ride in which the riders watch an audiovisual work while sitting in the ride vehicle 100. While watching the audiovisual work, the ride vehicle 100 moves in a manner that corresponds with the scene of the audiovisual work from the first person's point of view. Therefore, the riders feel as if they are actually part of the scene.

At the simulator ride, the transition vehicle 200 may be controlled by the central control unit. The central control unit may also operate the audiovisual work. This allows the central control unit to move the car 102 in a manner that corresponds with the audiovisual work. As such, the control unit may be operatively connected to the lift mechanisms 254 of the base 250.

Once the simulator ride is completed, the car 102 may be restored to its stable position and transported to the next ride by the transition vehicle 200. The next ride may be a dark ride in which the transition vehicle 200 maneuvers through a path generally within a housing. The housing also contains a variety of characters and other material generally related to a specific theme so that the rider feels as if he is in a particular location. In the dark ride, the control unit may control the path taken by the transition vehicle 200. The control unit may also be operatively connected to the lift mechanism 254 to control movement associated with the ride. The control unit may not only maneuver the transition vehicle 200 in the dark ride, but also move the lift mechanisms 254 in a distinct pattern to give the rider a real life experience of role-play through the themed ride.

This can continue on from one ride to another with unlimited possibilities. In some embodiments, patrons can arrive at an amusement park, secure themselves inside of a car 102, and be taken through the entire park, being taken from ride to ride by the transition vehicle 200. In some embodiments, the riders can even wait in line while sitting in their cars 102. In some embodiments, the cars 102 may have an entertainment system to keep the riders entertained while waiting in line or being transported from one ride to another. For example, the entertainment system may comprise the speakers 114*a-c*, the screens 219, the steering mechanism 126, and the like on the car. Other components, such as smaller monitors similar to game consoles may be provided adjacent to the steering mechanism or incorporated with the navigation system 304. Games, trivia, movies, music, television programs, news, and the like may be played on the entertainment system to keep the riders preoccupied when not actively participating in a ride. The steering mechanism 126 or some other input device may be provided to use the entertainment system. When used with the entertainment system, the steering mechanism may be disengaged from steering the transition vehicle 200.

The entertainment system can also be used to enhance the ride experience by producing sights and sounds associated with the ride itself. In some embodiments, the monitor may be a touchscreen and/or the steering mechanism 126 or some other input devices may be used to allow the rider to interact with the entertainment system.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. A method of entertaining amusement park patrons, comprising:

a. providing a car for the patrons to ride;

b. sending the car through a first ride;

c. upon completion of the first ride, sending the car through a second ride; and d. upon completion of the second ride, sending the car through a third ride, wherein the first ride is different from the second ride, the second ride is different from the third ride, and the third ride is different from the first ride, wherein at least one of the first, second, or third ride comprises a ride track, wherein transitioning the car from one of the first, second, or third rides to another of the first, second, or third rides comprises placing the car securely onto a transition vehicle, the transition vehicle comprising a pod, wherein the pod comprises a track segment and a braking system, wherein the car and the track segment are removable from the first, second or third types of ride, wherein the ride track comprises a gap into which and from which the track segment can be inserted and removed, respectively, wherein the track segment comprises a sensor to facilitate alignment with the ride track, and wherein the transition vehicle further comprises a base, wherein the pod is mounted on the base, and wherein the base comprises a set of ground wheels attached to a bottom side of the base to send the car from one ride to another ride, and wherein the pod and the terminal ends of the ride track are configured such that the terminal ends are housed inside the pod during alignment of the track segment and the ride track to prevent unnecessary rotational movement of the pod.

2. The method of claim 1, wherein the car and the track segment is moved from one ride to another ride without a track system in between the first, second, and third rides.

3. The method of claim 1, wherein the step of sending the car through at least one of the first, second, or third rides comprises using a lift mechanism operatively connected to the base and the pod to create movement selected from the group consisting of roll, yaw, and pitch in coordination with an audiovisual work to give the patron a feeling of being in the audiovisual work, wherein the lift mechanism comprises a plurality of hydraulic jacks connecting the base to the pod.

4. The method of claim 3, wherein the step of sending the car through at least one of the first, second, or third rides comprises playing the audiovisual work on a screen attached to the transition vehicle on a left or right side of the transition vehicle, wherein the patrons are seated in seats arranged in stadium-seat arrangement with a second row elevated higher than a first row and a third row higher than the second row so that riders in the second and third rows can see over riders in front of them.

5. The method of claim 4, wherein the step of sending the car through at least one of the first, second, or third rides having a ride track comprises releasing the car from the pod and onto the ride track, wherein sending the car from one ride to another ride comprises using a steering mechanism that controls the transition vehicle when the car is in between rides.

6. The method of claim 1, wherein the first, second, and third rides are each selected from the group consisting of a roller coaster ride, a simulator ride, a dark ride, a falling ride, and a swinging ride.

7. The method of claim 3, wherein the plurality of hydraulic jacks are connected to the pod via a plate.

8. The method of claim 7, where in the plate is rotatably connected to the pod.

* * * * *